US005702002A

United States Patent [19]

Harrison et al.

[11] Patent Number: 5,702,002

[45] Date of Patent: Dec. 30, 1997

[54] PACKED ELECTRIC LAMP

[75] Inventors: Guy N. P. Harrison, Bentley near Farnham Surrey, Great Britain; Wilhelmus J. J. Van Hest, Eindhoven, Netherlands

[73] Assignee: U.S. Philips Corporation, New York, N.Y.

[21] Appl. No.: 616,385

[22] Filed: Mar. 15, 1996

[30] Foreign Application Priority Data

Mar. 17, 1995 [EP] European Pat. Off. ..... 95200655
Jan. 22, 1996 [EP] European Pat. Off. ..... 96200142

[51] Int. Cl.[6] ..... B65D 85/42

[52] U.S. Cl. ..... 206/418; 206/775; 206/782; 206/783

[58] Field of Search ..... 206/418, 421, 206/422, 434, 718, 723, 775, 782, 783, 504; 229/89, 90, 117.04, 117.03, 121, 915

[56] References Cited

U.S. PATENT DOCUMENTS

| | | | |
|---|---|---|---|
| 3,337,033 | 8/1967 | Cote | 206/418 |
| 3,493,103 | 2/1970 | Cote | 206/418 |
| 3,734,397 | 5/1973 | Cote | 206/418 |
| 4,561,542 | 12/1985 | Przepiora et al. | 206/418 |
| 4,717,022 | 1/1988 | Combs | 206/418 |
| 4,773,539 | 9/1988 | Nock | 206/418 |

FOREIGN PATENT DOCUMENTS

| | | |
|---|---|---|
| 1854368 | 6/1982 | Germany . |
| 203953 | 9/1923 | United Kingdom . |
| 696597 | 9/1953 | United Kingdom . |

*Primary Examiner*—David T. Fidei
*Attorney, Agent, or Firm*—Walter M. Egbert, III

[57] ABSTRACT

The packaging carton of the packed electric lamp has an incision line through diagonally opposed edges in respective side walls adjoining these edges. Boundary lines extend in each of the two side walls from said incision line to a point P of the edge, which point lies closer to the first end, so as to define together with the incision line a region of said walls which is flipped over as a folded portion into the carton, thus narrowing the carton. The lamp may be readily machine packed into the carton, starting from the back of the carton, and displays essential distinguishing marks of its bulb while the packaging remains closed.

22 Claims, 4 Drawing Sheets

PACKED ELECTRIC LAMP

BACKGROUND OF THE INVENTION

The invention relates to a packed electric lamp comprising:

an electric lamp with a light-transmitting bulb which has an end portion supporting a lamp cap;

around the electric lamp, a packaging carton of substantially rectangular cross-section with first and second mutually opposed side walls, which side walls are interconnected along edges of the carton formed on folding lines, and with a first end near the lamp cap and a second end opposed thereto near the bulb, which carton has a respective incision line through diagonally opposed edges in the respective side walls adjoining said edges, boundary lines extending from said incision line in each of the two respective side walls to a point P of the intersected edge, which point lies closer to the first end, so as to limit together with the incision line a region of said side walls which is pivoted into the carton as a fold, thus narrowing the carton, the incision line forming the cutting edge of the fold, which carton has means near the second end for blocking the passage of the lamp.

Such a packed electric lamp is known from GB-A 696,597. A fold is present therein around all edges in the carton, which fold is directed towards the second end. The lamp has a spherical bulb with a neck-shaped portion which supports the lamp cap. The bulb is suspended with its spherical portion on the folds, in its zone of comparatively great diameter, in contact with an edge of the incision lines, the cutting edges of the folds. The carton has a second set of identical folds, mirrored in the centre of curvature of the spherical bulb, which folds form the means near the second end of the carton which prevent the lamp from passing to the exterior.

Since material has been cut from the carton walls and pivoted inwards in the form of folds, windows have been created in the carton walls. Since the folds are adjacent the greatest diameter of the bulb, they can be comparatively small while nevertheless bridging the distance between the bulb and the carton. Their position which is directed upwards and pivoted inwards through a comparatively small acute angle in addition entails that they largely obstruct the window which was comparatively small to begin with. The carton is circumferentially closed at the area of greatest diameter of the bulb itself. The windows show little of the lamp.

In general, the bulb of an electric lamp, especially an electric incandescent lamp, is much wider than the lamp cap. This means, also owing to the small mass of such a lamp, that the end portion with the lamp cap can occupy a fairly arbitrary position in the carton, such as against a wall or in a corner between two walls.

GB-A 203,953 discloses a packed electric lamp whose packaging carton has a platform at a distance from the first end, formed by four dual-hinge flaps which hinge about a concave folding line and are provided with a convex folding line, the platform having an opening through which the lamp cap is just passed, but which does keep the lamp cap inside the carton. Near the second end of the carton, four similar folds are cut out and hinged inwards as in the packaging described above. The carton has a conventional closure at the second end. The folds form a buffer for the bulb. The operations for erecting the carton and packing the lamp are numerous and complicated.

A packed electric lamp with a similar platform with an opening for the lamp cap is known from DE-A 1 854 368. The second end of the carton here has four flaps glued together two-by-two, which lie inside the carton while it is still flat and which form a self-closing end face when the carton is formed. The lamp is inserted into the carton, which is still open at the first end, with its bulb in front. It is necessary for the lamp cap to be centred before subsequently flaps at the first end can be closed, which are to form the recessed platform with the opening. The carton for this purpose has a long, transverse incision across each edge near the first end, and a comparatively short incision beyond half the height. The ends of said incisions are interconnected by folding lines, about which lines the intermediate region has been folded inwards. The lamp inserted into the carton is pressed into a centred position in that the folds are made, after which the platform is shaped. The folds practically completely obstruct the windows from which they originate. In spite of the self-closing second end, packagaing of the lamp with the four folds and the dual-hinge flaps is complicated.

Electric lamps for consumer use are available in a wide variety. It is often felt to be desirable to take a lamp from its packaging in order to ascertain that the correct choice is made as to bulb shape, mirror coating, finish, or colour. Added to this, operating voltage, wattage, lamp life, colour temperature and lumen output (may) play a part. Some information on the lamp may be most conveniently presented by the lamp itself, other information is most clearly presented alphanumerically. If a lamp is destined for a sales area in which several languages are spoken, it is desirable for the printed information to be given in each of these languages. Preferably, one side of the packaging should provide enough space for this.

SUMMARY OF THE INVENTION

It is an object of the invention to provide a packed electric lamp of the kind described in the opening paragraph in which the lamp may be readily machine-packed, and which displays essential characteristics of the bulb while the packaging remains closed.

According to the invention, this object is achieved in that an incision line is present in only two of the edges, and the folds pivoted into the carton extend towards the lamp cap of the lamp.

When the electric lamp is inserted into the carton through the second end with the lamp cap in front and is released (dropped), the portions hinged inwards force the end portion of the bulb, and thus the entire lamp, into a centred position.

Since the folds cooperate with a narrow portion of the lamp, they have to bridge a comparatively great distance between carton and lamp, and the windows created thereby in the walls are comparatively large and wide open. In addition, the windows may be easily enlarged in a single operation during making of the blank of the carton, whether for technical or aesthetic reasons, without impairing the retention of the lamp in the carton or the protective function of the carton. In spite of the large windows, the carton has a comparatively great strength in its longitudinal direction because only two edges are cut through, in contrast to the packaging cartons from the cited literature. The two remaining edges still make their full, essential contributions to the supporting force of the carton. This is of importance when the packed lamps are stacked.

It may be favorable when the carton has an at least partly closed end face at its first end, also for creating a stable base surface by means of which the packed lamp can be stacked on top of another lamp. The carton may for this purpose, for example, have a self-closing end face, but alternative end faces may also be used such as, for example, a conventional closure, such as a flap which hinges at a side wall with a closing flap connected thereto which is inserted into the carton. It is favorable for fixation of the closing flap when the adjacent walls have folded side flaps.

A central portion of each incision line may extend transversely to the edges, merge into adjoining portions at an angle, and thus connect to the boundary lines, for example with a kink or bend. Alternatively, a region may be present in the central region, near the edge, which region is concave towards the second end of the blank of the carton. The folds will then each surround the lamp over a certain angle in the shaped carton. This embodiment provides an increased dimensional tolerance.

Flipping over of the folds into the shaped carton is accompanied by a temporary deformation of the carton because the incision lines each extend in two mutually adjoining side walls. The boundary lines enclose an obtuse angle in the carton blank. It is favorable when this angle is approximately 120°±10°. The folding lines in the folds originating from the edges then enclose a wide obtuse angle with one another, for example of 130°±10°, in the shaped carton, so that the lamp when dropped into the carton automatically centres itself in the diagonal plane through said edges. It is convenient to move the regions inward while the carton is being erected from its flat shape obtained from the blank.

In a favorable embodiment, the folds are subdivided by a line, for example a cuff crease line, on either side of the folding line originating from the relevant edge. In the blank of the carton, for example, these lines may be bisectors. The lines facilitate pivoting of the folds into the interior, because in this embodiment no or substantially no deformation of the carton occurs during pivoting. The lines give the cutting edge of each fold a planer, and also a steeper aspect, which also facilitates guiding of the lamp into its end position. The angle enclosed by the folding lines is even greater then, for example 180°±10°.

It is favorable when the carton has a window at the area of the lamp cap at least near one fold, for example in each of the side walls of said fold. In geographic areas where lamps with different lamp caps are in use, such as bayonet or threaded caps, the correct lamp may then be readily chosen without printed information. It is in addition attractive when an additional window is present in a side wall at the area of greatest bulb diameter, for example in the side wall or side walls comprising the windows for the lamp cap. In geographic areas where both lamps with clear bulbs and bowl mirror lamps, lamps with an e.g. hemispherical minor coating opposite the lamp cap, are in use, the difference between these two types may then be readily observed. This is because the mirror coating has its boundary substantially at the area of greatest bulb diameter.

In an advantageous embodiment of the packed lamp according to the invention, the carton comprises as means of blocking the passage of the lamp first and second tags which are present at the first and second side walls, respectively, and which are interconnected via wedges at the edges of the carton. These tags are folded about transverse lines so as to narrow the carton at its second end.

The wedges here lie inside the carton, each have a first folding line which forms an extension of the corresponding edge when the carton is open, and are bounded on either side of said edge by a second line along the first tags and a third line along the second tags, which lines start from the relevant edges and along which lines folding takes place, these lines each enclosing an angle of less than 90° in the blank of the carton.

The first tags project obliquely into the carton, while the second tags extend substantially in a plane through the transverse lines.

In a special embodiment of the packed electric lamp according to the invention, the incision line in each of the two edges of the carton is not symmetrical, but asymmetrical relative to that edge. The boundary line encloses an angle of less than 45° with the edge in the relevant first side wall, while the second side wall is substantially completely traversed by the boundary line, which runs substantially perpendicular to the edge. The incision line gives the fold a concave cutting edge which grips around the lamp.

In a modification of this embodiment, the second end of the carton is at least substantially closed, for example by means of a flap hinged to a side wall and connected to a closing tag and possibly to side flaps. The folds with the lamp and the closure of the second end in this modification give the carton such a stiffness that the first end may remain entirely open. This provides a saving in packaging material and makes for very easy packaging.

The carton may be formed from material comprising cellulose, for example cardboard, for example semi- or mini-corrugated cardboard and the like, but in particular from duplex cardboard.

The bulb of the electric lamp may have a shape chosen from a wide variety: spherical, spherical with a neck-shaped end portion, ovoidal, possibly with a dome-shaped free end, mushroom-shaped, etc.

BRIEF DESCRIPTION OF THE DRAWINGS

An embodiment of the packed electric lamp according to the invention is shown in the drawings, in which.

DESCRIPTION OF THE PREFERRED EMBODIMENTS

Figure 1:
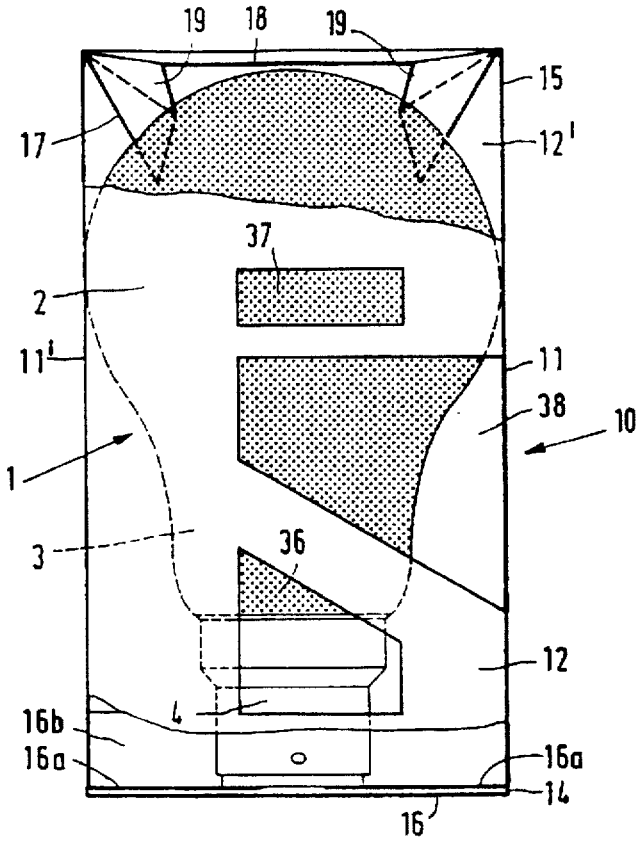
FIG. 1 shows the packed electric lamp partly in elevation, partly in axial longitudinal sectional view.
Figure 2:
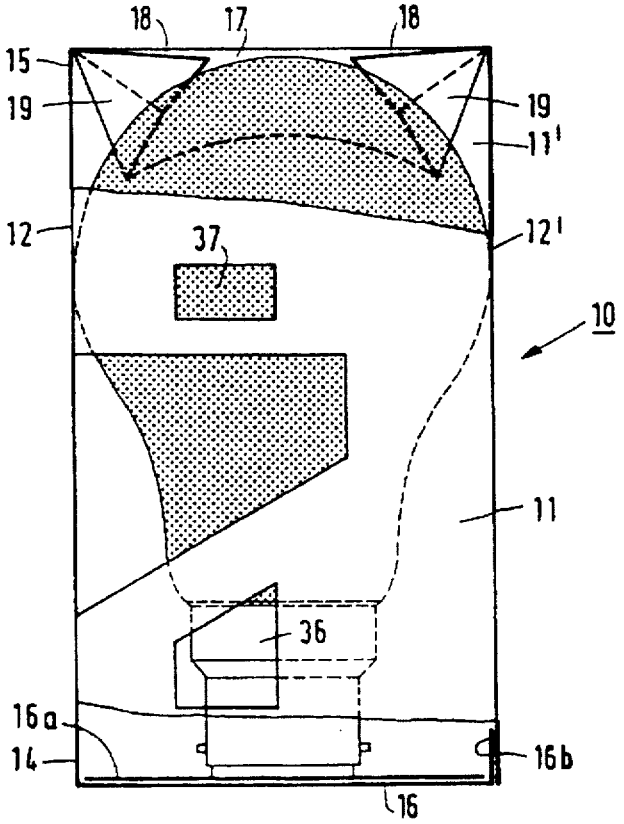
FIG. 2 shows the packed electric lamp of FIG. 1 rotated through 90°.
Figure 3:
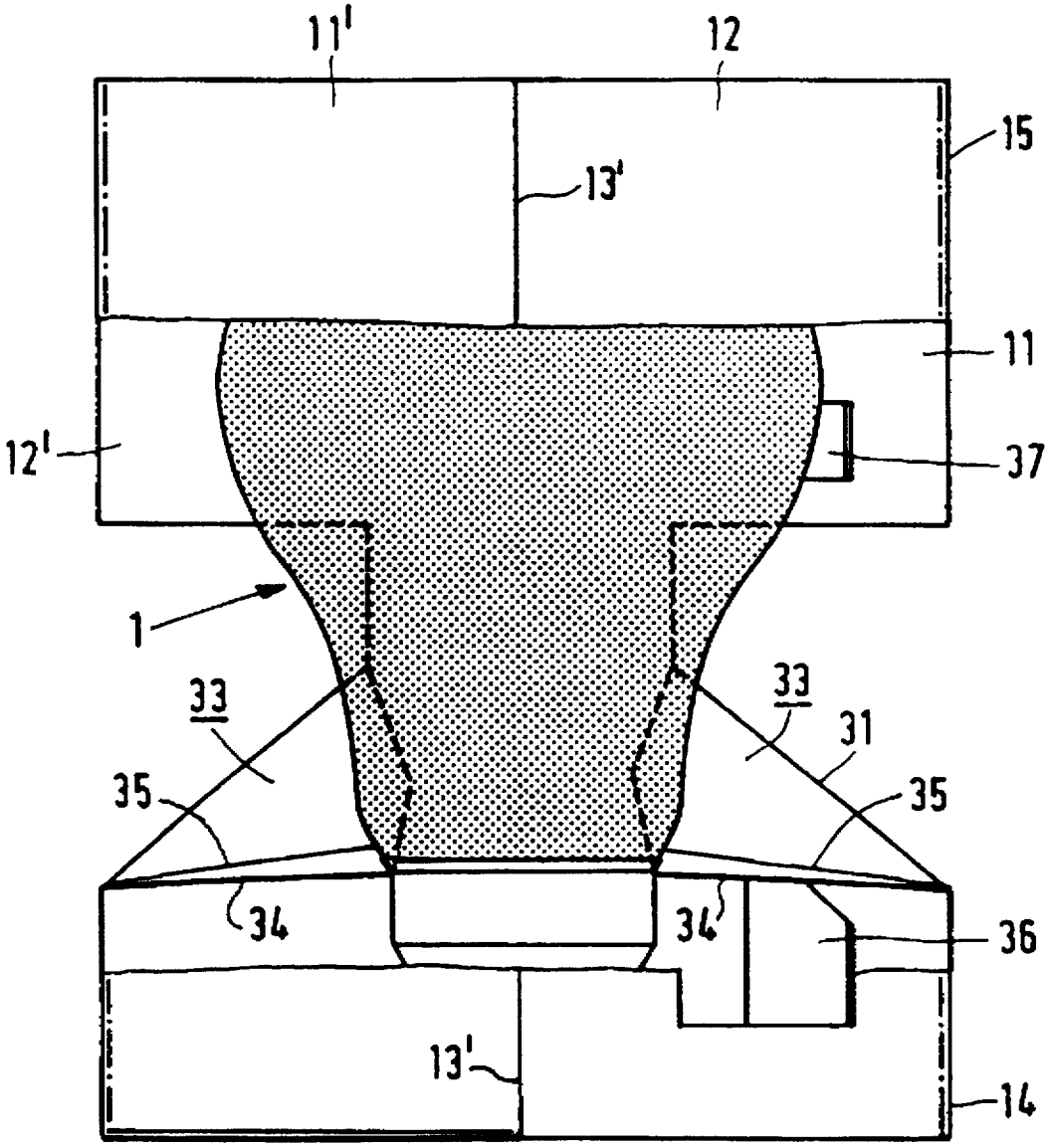
FIG. 3 shows the packed electric lamp of FIGS. 1 and 2 in the intermediate diagonal position, partly in cross-section, partly in elevation.

In the packed electric lamp of FIGS. 1, 2 and 3, an electric lamp 1 with a light-transmitting bulb 2 having an end portion 3 supporting a lamp cap 4 is accommodated in a packaging carton 10 of substantially rectangular cross-section, made of duplex cardboard in the Figure. The bulb drawn is spherical and has a neck-shaped portion. Lamps without such a neck-shaped portion and lamps with a bulb curved into a shape other than a spherical shape, however, may be accommodated in similar, possibly differently dimensioned cartons.

The carton has first 11, 11' and second mutually opposed side walls 12, 12', which side walls are interconnected along edges 13, 13' of the carton formed along folding lines, and also a first end 14 near the lamp cap 4 of the lamp and a second end 15 opposed thereto near the bulb 2.

The carton 10 has a respective incision line 30 through diagonally opposed edges 13', in the side walls 11, 12 and 11', 12', respectively, which adjoin these edges 13'. Boundary lines 31, 32 run from said incision line 30 in each of the respective two side walls 11, 12 and 11', 12' to a point P of the intersected edge 13', which point lies closer to the first end 14, so as to limit together with the incision line 30 regions of said side walls 11, 12 and 11', 12' which are pivoted into the carton 10 as folds or folded portions 33, thus narrowing the carton. The incision line 30 thus forms the cutting edge of the fold 33 here.

The carton has means near the second end 15 which block the passage of the lamp.

An incision line 30 is present in only two edges 13'. The folds 33 flipped over into the carton 10 extend towards the lamp cap 4 of the lamp 1.

Figure 4:
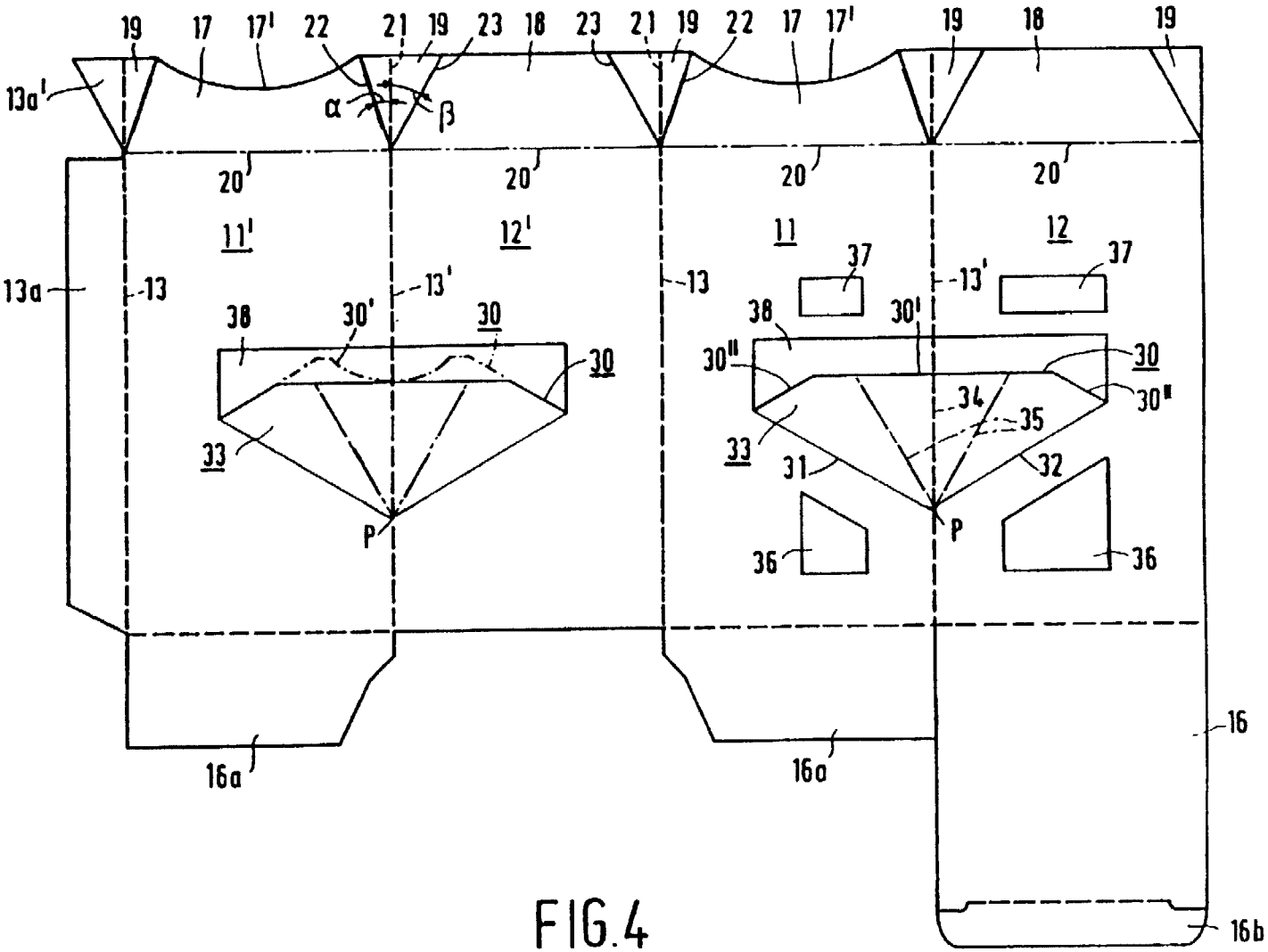
FIG. 4 shows the blank of the carton of the preceding Figures.

The first end 14 of the carton has an end face which is closed at least partly by a closure 16 provided with a closing flap 16*b* and side flaps 16*a* (see also FIG. 4).

The incision lines 30 each have a central portion 30', transverse to the edges 13' (see FIG. 4), and adjoining portions 30" which merge into the central portion at an angle thereto and connect with the boundary lines 31, 32.

The boundary lines 31, 32 enclose an angle of 120°±10° in the blank of the carton.

The folds 33 each have a line 35 on either side of the folding line 34 originating from the relevant edge 13', in the Figure the bisector of the angle between the folding line 34 and the relevant boundary line 31, 32, a fold being made on said lines 35. The lines 35 are cut/crease lines.

The carton 10 has a window 36 at the area of the lamp cap 4 near a fold 33.

The side walls 11, 12 having such a window 36 have an additional window 37 at the area of greatest diameter of the bulb 2.

The second end 15 of the carton has first 17 and second tags 18 which are present at the first and second side walls 11, 11'; 12, 12', respectively, and which are interconnected via wedges 19 at the edges 13, 13' of the carton. The tags 17, 18 are folded about transverse lines 20 so as to narrow the carton 10 at its second end 15. The wedges 19 lie inside the carton 10 and each have a first folding line 21 which forms an extension of the corresponding edge 13, 13' when the carton is open (cf. FIG. 4) and are bounded on either side thereof by a second line 22 lying alongside the first tags 17 and a third line 23 lying alongside the second tags 18, around which lines a fold has been made. The lines 22, 23 start from the corresponding edges and each enclose an acute angle with the first folding line 21.

The second 22 and third line 23 of each wedge 19 enclose an angle of less than 90° in the blank of the carton. The first tags 17 project into the carton obliquely and the second tags 18 extend substantially in a plane through the transverse lines 20.

A first tag 17, and in the Figures beth first tags owing to the shape of the bulb and its centred position, is substantially transverse to the bulb 2.

The first tags 17 each have an outer surface which encloses an acute angle with the bulb 2. The first tags 17 have concave edges 17'.

In the embodiment drawn (FIG. 4), the second lines 22 of the wedges 19 are cut/crease lines. The third lines 23 of the wedges 19 are score lines. The transverse lines 20 are also score lines.

The second 22 and third lines 23 of the wedges 19 enclose an angle of 50°±10° in the blank of the carton. In the figures, the second lines 22 enclose an angle α of 20°±5°, and the third lines 23 an angle β of 30°±5° with the first folding lines 21. The carton keeps the lamp securely fixed. FIG. 4 shows how much material is required for the conventional closure with which the first end 14 of the carton is provided. The closure 16, large in itself, is extended with a closing flap 16*b* which is inserted into the carton. In addition, comparatively large side flaps 16a are present. FIG. 4 clearly demonstrates the difference in quantity of material present at the first and at the second end of the carton to be shaped, and also renders it evident that considerably smaller cutting losses occur at the second end. However, the carton may be provided with an alternative closure at its first end.

FIG. 4 shows a glue strip 13*a*, 13*a*' with an interruption at the area of the transverse line 20. The glue strip is adhered to the side wall 12 with the closure 16 so as to obtain a flat carton which may be supplied to a packaging machine. Said interruption serves to prevent the carton becoming too rigid locally. The three-dimensional carton may be readily shaped from the flat carton and closed at its first end. Then the lamp is inserted and the second end is closed, for example, in that the first tags are pushed obliquely inwards.

The Figure shows that the openings 38 in the shaped carton which will arise when the folds 33 have been pivoted inwards are greater than the opening caused by the folds. The object of this is to present a completer picture of the lamp, and has been realised by means of additional incisions. Windows 36 are present near one of the two folds 33 at the area of the lamp cap, one in each side wall 11, 12. There is also an additional window 37 at the area of greatest diameter of the bulb, in the embodiment drawn also one in each of the side walls which has a window 36. The two types of windows have the same dimensions perpendicular to the edge 13', but different ones in side wall 11 and in side wall 12 for stylistic reasons.

In spite of the opening and the windows, the blank of the carton still provides ample space for alphanumerical information, e.g. in one of the side walls. It is indicated with a dash-dot line how the incision line may be varied in an alternative embodiment so as to give the fold 33 a cutting edge having a central portion 30' with a concave shape around the edge 13'.

The packed electric lamp may well serve for stacking another one on top. A stable base surface is offered for this purpose.

Figure 5:
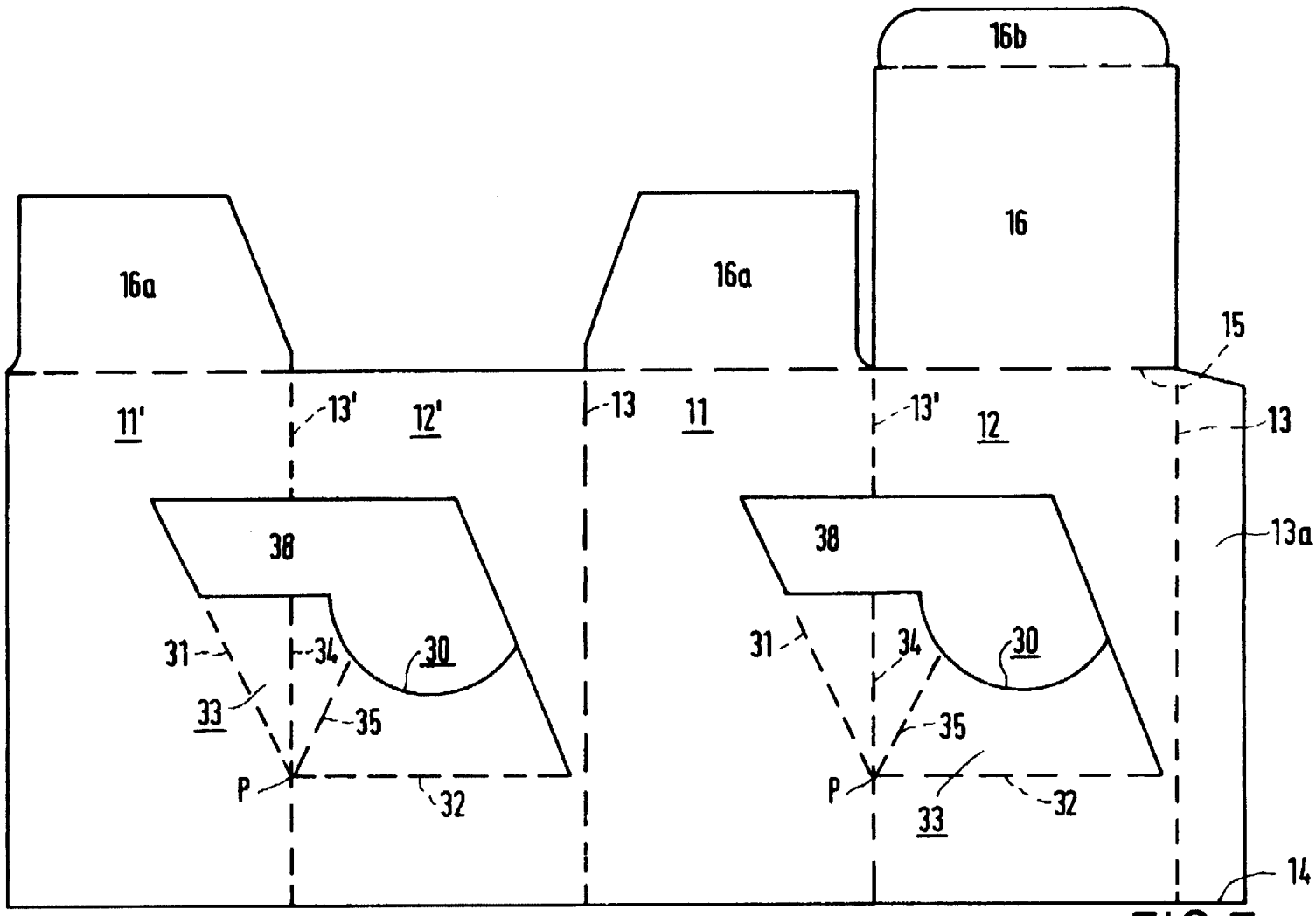
FIG. 5 shows the blank of another embodiment of the carton.

In FIG. 5, parts corresponding to those in FIG. 4 have been given the same reference numerals.

The carton to be shaped from the blank shown is fully open at its first end 14 and fully closed at its second end 15 by means of a flap 16 with a closing tag 16*b* and cooperating side flaps 16*a*.

The incision line 30 is asymmetrical and bounds, with boundary lines 31, 32, a region which will form a fold 33.

The boundary line 31 in the first side wall 11 encloses an angle of less than 45° with the folding line 34 which originates from the edge 13'. The boundary line 32 traverses the second side wall 12 substantially entirely and is substantially perpendicular to the edge 13'.

The incision line 30 gives the fold 33 a concave cutting edge which will grip around a lamp. The portion of the fold 33 between the boundary line 31 and the folding line 35 extends, substantially flat, at a small angle to the first side wall 11.

We claim:

1. A packed electric lamp comprising:

an electric lamp with a light transmitting bulb which has an end portion supporting a lamp cap;

a packaging carton around the electric lamp having a substantially rectangular cross-section, the carton having a first pair of mutually opposed side walls and a second pair of mutually opposed side walls, the pairs of side walls being interconnected along edges of the carton formed on folding lines, the carton having a first end near the lamp cap and a second end opposed thereto near the bulb, the carton having an incision line through one of the edges and respective side walls adjoining said edge, boundary lines extending from said incision line in each of the two respective side walls to a point of the edge intersected by the incision line, which point lies closer to the first end, so as to define together with the incision line a region of said side walls which is pivoted into the carton as a folded portion, thus narrowing the carton, the incision line forming an edge of the folded portion, the carton having means near the second end for blocking passage of the lamp, characterized in that: the incision line is present in only two of the edges, and the folded portions pivoted into the carton extend towards the lamp cap of the lamp.

2. A packed electric lamp as claimed in claim 1, characterized in that the first end (14) of the carton has an end face which is closed at least partly.

3. A packed electric lamp as claimed in claim 2, characterized in that the incision lines each have a central portion transverse to the edges and adjoining portions (30") merging into said central portion at an angle thereto and connecting to the boundary lines.

4. A packed electric lamp as claimed in claim 3, characterized in that the boundary lines enclose an angle of 120°±10° in a blank of the carton.

5. A packed electric lamp as claimed in claim 3, characterized in that the folded portion each have a line on either side of a folding line originating from the relevant edge, on which lines folding has taken place.

6. A packed electric lamp as claimed in claim 5, characterized in that the tines are cut/crease lines.

7. A packed electric lamp as claimed in claim 3, characterized in that the carton has a window near a folded portion at the area of the lamp cap.

8. A packed electric lamp as claimed in claim 7, characterized in that a side wall comprising a window has an additional window substantially at the area of greatest diameter of the bulb.

9. A packed electric lamp as claimed in claim 1, characterized in that the incision line is asymmetrical, and in that the boundary line in the first side wall encloses an angle of less than 45° with the edge, while the boundary line traverses the second side wall substantially entirely and is substantially perpendicular to the edge, and the incision line gives the folded portion a concave which grips around the lamp.

10. A packed electric lamp as claimed in claim 9, characterized in that the first end of the carton is fully open and the second end substantially closed.

11. A packed electric lamp as claimed in claim 1, characterized in that the incision lines each have a central portion transverse to the edges and adjoining portions merging into said central portion at an angle thereto and connecting to the boundary lines.

12. A packed electric lamp as claimed in claim 2, characterized in that the boundary lines enclose an angle of 120°±10° in the blank of the carton.

13. A packed electric lamp as claimed in claim 1, characterized in that the boundary lines enclose an angle of 120°±10° in the blank of the carton.

14. A packed electric lamp as claimed in claim 2, characterized in that the folded portion each have a line on either side of a folding line originating from the relevant edge, on which lines folding has taken place.

15. A packed electric lamp as claimed in claim 14, characterized in that the lines are cut/crease lines.

16. A packed electric lamp as claimed in claim 1, characterized in that the folded portions each have a line on either side of a folding line originating from the relevant edge, on which lines folding has taken place.

17. A packed electric lamp as claimed in claim 16, characterized in that the lines are cut/crease lines.

18. A packed electric lamp as claimed in claim 2, characterized in that the carton has a window near one of the folded portions at the area of the lamp cap.

19. A packed electric lamp as claimed in claim 18, characterized in that a side wall comprising a window has an additional window substantially at the area of greatest diameter of the bulb.

20. A packed electric lamp as claimed in claim 1, characterized in that the carton has a window near one of the folded portions at the area of the lamp cap.

21. A packed electric lamp as claimed in claim 20, characterized in that a side wall comprising a window has an additional window substantially at the area of greatest diameter of the bulb.

22. A packed electric lamp as claimed in claim 1, wherein said incision lines are present through said edges diagonally opposed with respect to said carton.

* * * * *